US005943903A

United States Patent [19]

Tseng

[11] Patent Number: 5,943,903

[45] Date of Patent: Aug. 31, 1999

[54] BINDING STRUCTURE FOR MULTIPLE SMALL AND THIN PIPES

[76] Inventor: Shao-Chien Tseng, No.130, Sec. 2. Yang-Shin Rd., Yang-Mei, Taoyuan 326, Taiwan

[21] Appl. No.: 09/032,772

[22] Filed: Feb. 28, 1998

[51] Int. Cl.[6] ..... B21D 7/00

[52] U.S. Cl. ..... 72/457; 29/897; 269/43; 269/287

[58] Field of Search ..... 72/457; 29/897, 29/897.34, 433, 455.1; 269/43, 287

[56] References Cited

U.S. PATENT DOCUMENTS

| | | | |
|---|---|---|---|
| 3,101,027 | 8/1963 | Brogan | 269/43 |
| 3,415,516 | 12/1968 | Mattingly | 29/897 |
| 3,877,690 | 4/1975 | Owens | 269/287 |
| 4,202,085 | 5/1980 | Vollmer | 269/43 |

FOREIGN PATENT DOCUMENTS

| | | | |
|---|---|---|---|
| 1280631 | 10/1968 | Germany | 269/287 |
| 554113 | 8/1957 | Italy | 269/287 |
| 0776849 | 11/1980 | U.S.S.R. | 269/43 |

*Primary Examiner*—David Jones
*Attorney, Agent, or Firm*—Pro-Techtor International Services

[57] ABSTRACT

A binding structure for multiple pipes includes a plurality of disks with holes to receive the pipes. The holes are offset on alternating disks so that the pipes are securely held between the multiple disks. Latching pins are used to fix the disks in position after the desired placement of the pipes is achieved.

4 Claims, 4 Drawing Sheets

BINDING STRUCTURE FOR MULTIPLE SMALL AND THIN PIPES

BACKGROUND OF THE INVENTION

1. Field of the Invention

The present invention is related to a simple binding structure for multiple small and thin pipes, and especially to a simple binding multiple structure for small and thin pipes used in handicraft. Both straight and bent pipes can be bound together. A group of concentrically arrayed disks are each provided with a plurality of holes. The holes on a given disk are slightly deviated relative to those on the neighboring disks in order to tightly bind the pipes extending through these holes.

2. Description of the Prior Art

Conventional larger and thicker pipes have greater strength as compared to smaller and thinner pipes. This increases the degree of difficulty in manipulating the pipes. Accordingly, it is easier to use smaller and thinner pipes for handicraft.

However, the smaller and thinner pipes are subject to deformation when they are worked. To overcome this problem, the standard techniques used require forging or molding with a machine. But working with a machine is against the premise of the handicraft art, i.e., the pipes are to be worked or modelled by hand. Moreover, processing with a machine creates an article of a predetermined shape. When a machine is used in the handicraft art, the process is complex process with higher cost, and is unable to be easily modified.

Single smaller and thinner pipes are not easily worked by the handicraft art. A plurality of pipes are more difficult. For example, it is very difficult to use a plurality of flexible pipes to form an imitation cane chair or cane desk or the like when working by hand.

SUMMARY OF THE INVENTION

The present invention has the following objects:

To provide a binding structure for simultaneously bending or straightening multiple pipes for shaping. The shaped or modelled pipes can be bound and positioned to easily form an article.

The present invention has the following advantages:

1. The present invention is suitable for bending or straightening and binding and positioning multiple common smaller and thinner pipes.
2. The number and positions of the disks used in the binding structure of the present invention depends on the specific areas on the pipe group to be processed for shaping.
3. The disk group includes at least three concentric round disks, each of which is provided with pipe holes which are deviated on alternating disks.
4. The alternating deviation of the pipes creates a slight difference of distance between the centers of the pipes and the centers of the disks.
5. The number of holes provided on the disks depends on the number of pipes to be used for shaping or modelling.
6. A suitable number of concentric pin holes are provided to receive a like plurality of latching pins for the disks to increase stability of the disks after binding.
7. The latching pins absorb forces so that after the disks are latched, they can absorb forces from the shaped pipes to increase stability of the pipes bound by the slightly deviated holes on the disks.

In the present invention, extension of the pipe group formed by multiple pipes through the disk group, bracing of the pipe walls to be shaped by the disks of the disk group, as well as binding and latching of the disks of a completed handicraft article, are all performed by hand.

The present invention will be further apparent after reading the detailed description of the preferred embodiments thereof in reference to the accompanying drawings.

DETAILED DESCRIPTION OF THE PREFERRED EMBODIMENT

Figure 1:
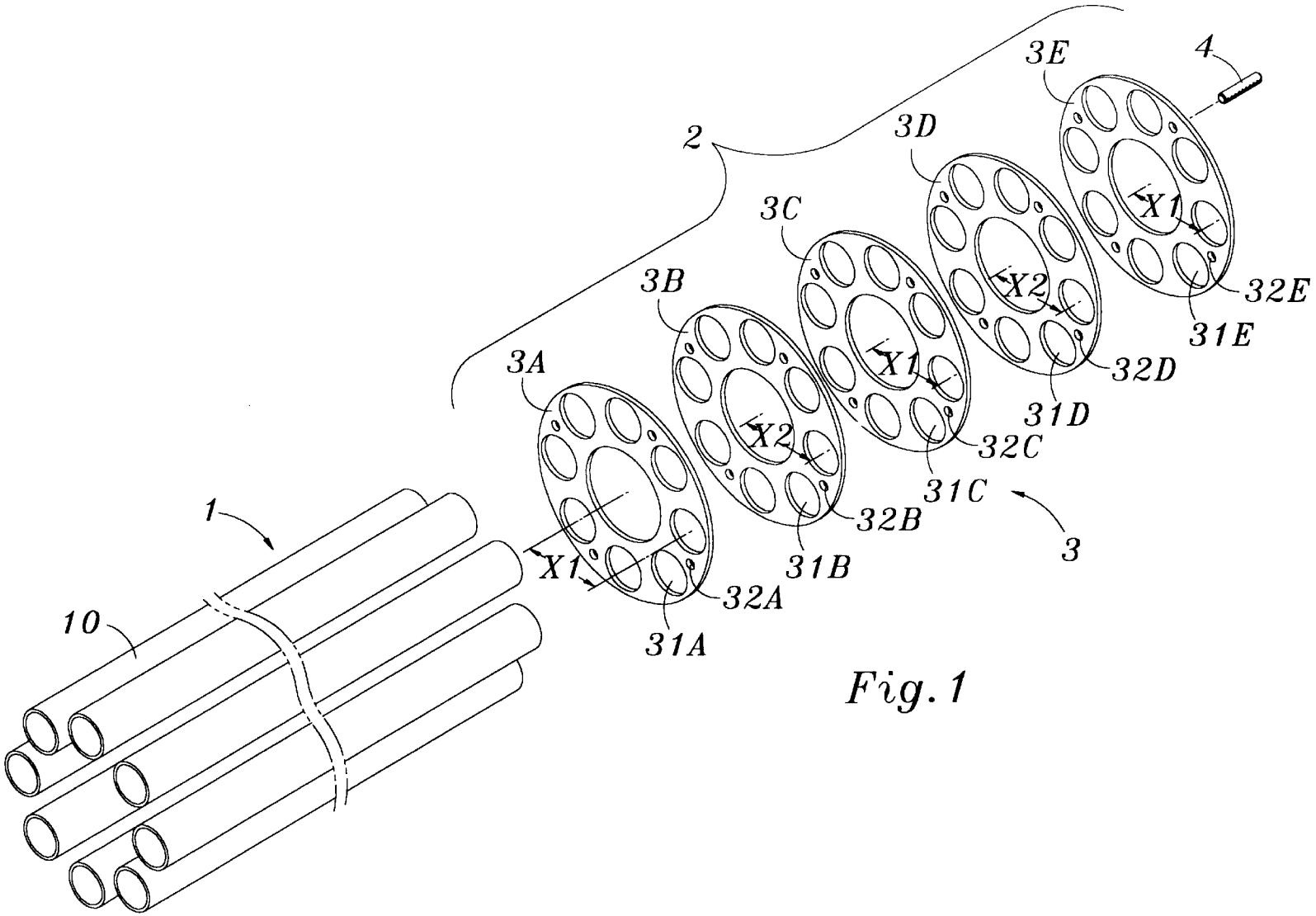
FIG. 1 is a perspective view of an embodiment of the present invention.
Figure 2:
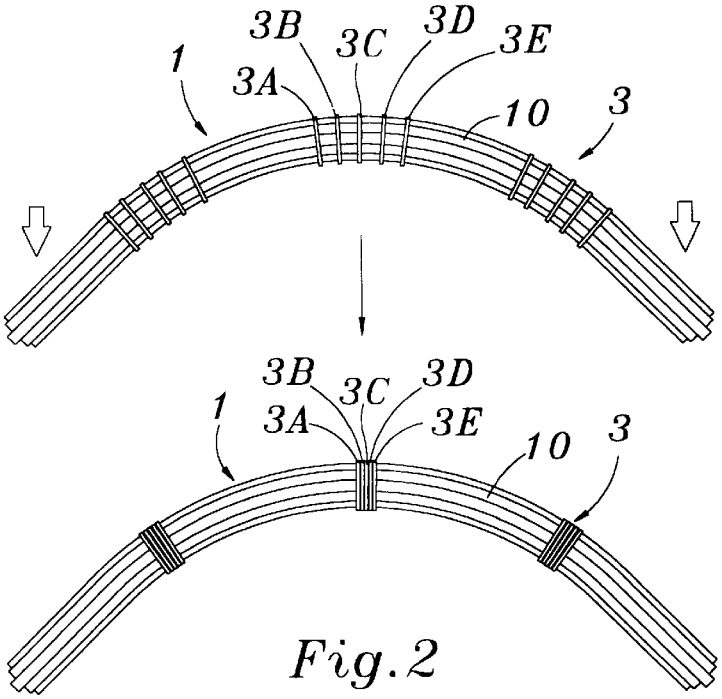
FIG. 2 is a schematic view wherein the pipe group to be bent for shaping is bound in position for processing.

FIGS. 1 to 5 show the structure of a preferred embodiment of the present invention. As shown in FIG. 1, multiple small and thin pipes 10 (in the embodiment shown, there are eight pipes), are arranged to form a pipe group 1.

A binding structure 2 comprising at least three disks 3A, 3B, 3C, 3D, 3E . . . forms a disk group 3 (there are five disks in this embodiment). A suitable number of latching pins 4 are added to complete the unit binding structure 2.

Each disk 3A, 3B, 3C, 3D, 3E of the pipe provided with a plurality of pipe holes 31A, 31B, 31C, 31D, 31E which are equal in number to that of the pipes 10 to be bound. Each disk 3A, 3B, 3C, 3D, 3E also includes pin holes 32A, 32B, 32C, 32D, 32E to receive the latching pins 4.

The pipe holes 31A, 31B, 31C, 31D, 31E of the disks 3A, 3B, 3C, 3D, 3E have alternating distances X1 and X2 from the center of the disks 3A, 3B, 3C, 3D, 3E. That is to say, the distance from the center of the pipe holes 31A, 31C and 31E of the disks 3A, 3C and 3E is X1, while the distance from the center of the pipe holes 31B and 31D of the disks 3B and 3D is X2. The slight difference between the distances X1 and X2 is necessary for the function of the present invention.

The pin holes 32A, 32B, 32C, 32D and 32E on the disks 3A, 3B, 3C, 3D and 3E are aligned, so that the pin holes 32A, 32B, 32C, 32D and 32E of each disk group 3 can receive latching pins 4.

Figure 3:
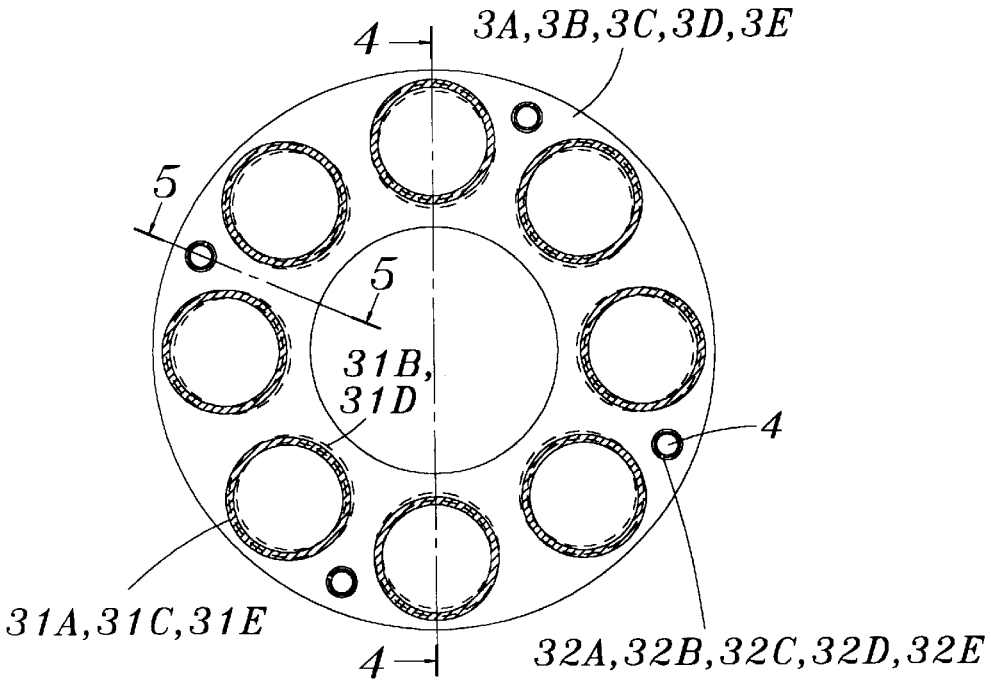
FIG. 3 is a sectional view showing an article formed with the present invention after binding.
Figure 4:
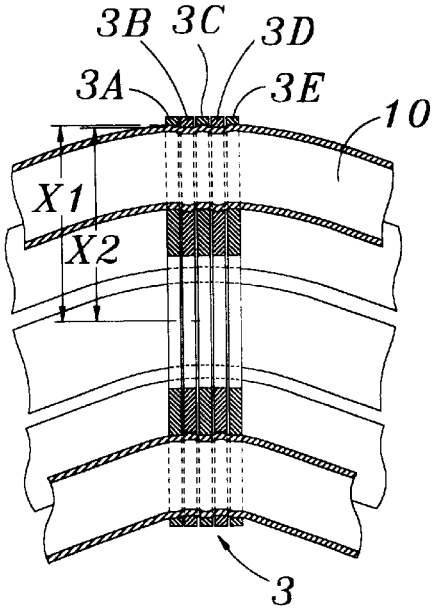
FIG. 4 is a sectional view taken from a sectional line 4—4 in FIG. 3.
Figure 5:
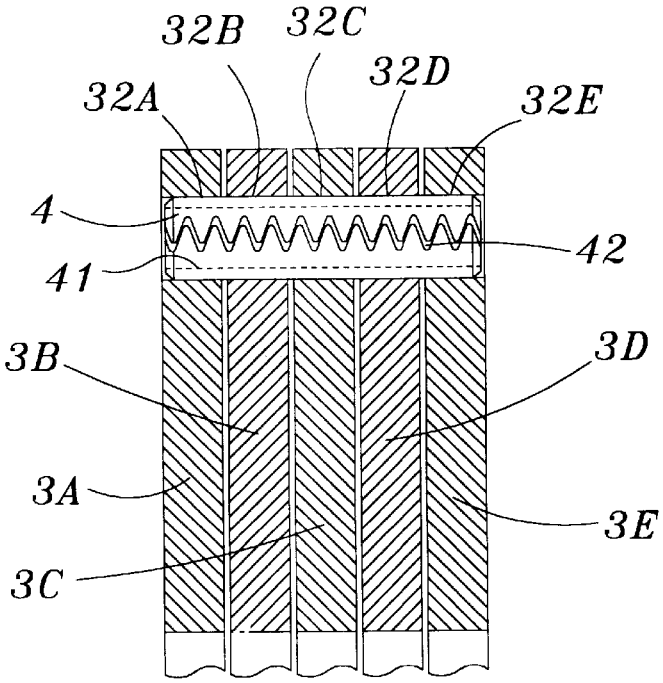
FIG. 5 is a sectional view taken from a sectional line 5—5 in FIG. 3.

In use, the area of the pipe group to be bent or held straight is secured by a disk group 3. Pipes 10 are inserted into the disks 3A, 3B, 3C, 3D, 3E of the disk group 3. When the disk group 3 is properly positioned, it is secured in place by the latching pins 4 inserted in the pin holes 32A, 32B, 32C, 32D, 32E to securely bind the pipes 10 of the pipe group 1 in the deviated pipe holes 31A, 31B, 31C, 31D, 31E of the disks 3A, 3B, 3C, 3D, 3E (as shown in FIGS. 3, 4). The pipes at the area with the disk group 3 thus are firmly fixed to maintain the bent or straightened state.

The latching pins 4 used in the binding process are conventional latching members. Each latching pin 4 has a central through hole 41 (see FIG. 5), and a toothed slot 42 on the wall thereof. When one of the latching pins 4 is acted on by a force in any direction, the force is absorbed by the surfaces of the toothed slot 42 on the latching pin 4. The latching pin 4 is a heavy-duty spring tension pin.

Figure 6:
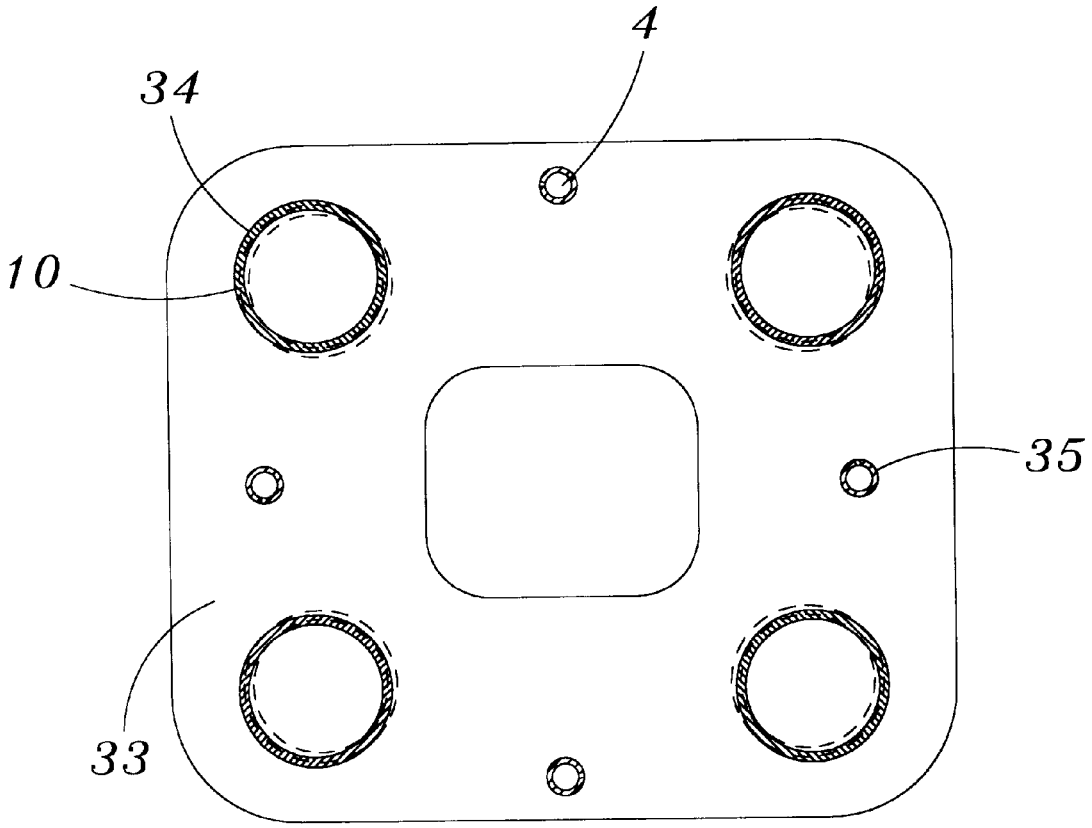
FIG. 6 is a sectional view of another embodiment of the present invention after binding.

The number of pipe holes 31A, 31B, 31C provided on the disks 3A, 3B, 3C . . . of the disk group 3 and the number of pipes 10 are not limited and can be varied depending on the requirement of a designer. Also, as is shown in FIG. 6, which shows another embodiment of the present invention, the shape of a securing element 33 is changed according to the number and positions of the pipes 10 being used. The pipe holes 34 of the securing element 33 are also deviated diagonally to tightly bind the pipes 10. A plurality of pin holes 35 are provided to receive latching pins 4.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A binding structure for multiple pipes comprising:

a pipe group formed from said multiple pipes, a disk group to receive said pipe group, and a plurality of latching pins; wherein said disk group includes at least three disks, each said disk includes a plurality of pipe holes, a number of said pipe holes is equal to a number of said pipes in said pipe group, each said disk further includes a plurality of latching pin holes to receive said latching pins; such that said disks are placed at an area on said pipe group, said pipes are received in said pipe holes, and said latching pins are inserted into said latching pin holes to secure said disks in position, pipe holes in alternating disks are positioned at varying distances from centers of said disks so that said pipe holes are slightly offset from one said disk to a next said disk so that said pipes are securely held therein.

2. The binding structure for multiple pipes as stated in claim 1, wherein:

a number of said pipe holes of each of said disks of said disk group equals a number of said pipes forming said pipe group.

3. The binding structure for multiple pipes as stated in claim 1, wherein:

distances from said pipe holes of said disks to centers of said disks vary on alternating disks so that said pipe holes on alternating disks are offset so that said pipes are bound therein.

4. The binding structure for multiple pipes as stated in claim 1, wherein:

each of said latching pins has a central through hole and a toothed slot on a wall thereof so that when one of said latching pins bears a force, the force is absorbed by a plurality of surfaces of said toothed slot on said latching pin.

* * * * *